US006577835B2

(12) United States Patent
Klerken

(10) Patent No.: US 6,577,835 B2
(45) Date of Patent: Jun. 10, 2003

(54) POWDER IMAGE TRANSFER SYSTEM WITH HEAT EXCHANGER

(75) Inventor: Pierre A. M. Klerken, Venlo (NL)

(73) Assignee: Oce-Technologies B.V., MA Venlo (NL)

( * ) Notice: Subject to any disclaimer, the term of this patent is extended or adjusted under 35 U.S.C. 154(b) by 0 days.

(21) Appl. No.: 09/901,105

(22) Filed: Jul. 10, 2001

(65) Prior Publication Data

US 2002/0003978 A1 Jan. 10, 2002

(30) Foreign Application Priority Data

Jul. 10, 2000 (EP) ..... 00202416

(51) Int. Cl.[7] ..... G03G 15/16
(52) U.S. Cl. ..... 399/307; 347/154
(58) Field of Search ..... 399/307, 162, 399/94; 347/154, 155, 156

(56) References Cited

U.S. PATENT DOCUMENTS 5,103,263 A 4/1992 Moore et al.
5,678,134 A 10/1997 Miki et al.

FOREIGN PATENT DOCUMENTS

JP 6-027833 2/1994
JP 08-095399 A * 4/1996

* cited by examiner

*Primary Examiner*—Joan Pendegrass
(74) *Attorney, Agent, or Firm*—Birch, Stewart, Kolasch & Birch, LLP

(57) ABSTRACT

An image transfer system comprising an endless belt serving as an image carrier and passing through a first processing station where it is maintained at a low temperature and through a second processing station where it is maintained at a higher temperature, and a heat exchanger formed by two portions of said belt moving in opposite directions and held in sliding contact with each other by a pressing member, the pressing member being a deflecting roller that co-rotates with the belt portion that is directly in contact therewith.

10 Claims, 2 Drawing Sheets

POWDER IMAGE TRANSFER SYSTEM WITH HEAT EXCHANGER

BACKGROUND OF THE INVENTION

The present invention relates to an image transfer system comprising an endless belt serving as an image carrier and passing through a first processing station where it is kept at a low temperature and through a second processing station where it is kept at a higher temperature, and a counter flow heat exchanger formed by two portions of said belt moving in opposite directions and held in sliding contact with each other by a pressing member.

An image transfer system is used for example in a copier or printer in which a toner image is developed on or transferred onto an image carrier in the first processing station and is then transferred onto a sheet of copy paper and fused thereon in the second processing station. Especially when the transfer step and the fuse step in the second processing station are combined into a single transfusion step, the belt needs to be heated to an elevated temperature before it is fed to the second processing station. On the other hand, the first transfer step or the developing step in the first processing station generally requires a lower belt temperature. In a specific type of copying or printing machine, the toner image is developed on a photoconductive drum or is directly formed on the surface of an electrode drum in a direct induction printing process and is then transferred to the belt which serves as an intermediate image carrier.

The arrangement in which portions of the belt are configured as a counter flow heat exchanger has the advantage that the losses of heat energy and hence the power consumption of the machine can be reduced significantly because a substantial part of the heat of the belt leaving the second processing station can be recovered and used for pre-heating the belt which is fed to the second processing station. In order to achieve a high efficiency of the heat exchanger and to reduce the length of the heat exchanger, it is preferable that the belt is formed by a relatively thin endless support and is made of a material which has a small heat capacity and a high thermal conductivity. Further, the two portions of the belt forming the heat exchanger should be held in close contact with each other. On the other hand, the force with which these two belt portions are pressed against one another should not be too large in order to limit the amount of friction between the belt surfaces.

U.S. Pat. No. 5,103,263 discloses an image transfer system of the type indicated above in which the heat exchanger is configured as a straight path defined between two deflecting rollers. One of the belt portions moves tangentially past the two deflecting rollers without being substantially deflected, whereas the other portion is deflected at both rollers so as to be in sliding contact with the first portion only in the straight path between the two deflecting rollers. A plate-like pressing member is used for slightly pressing the second belt portion against the first one over the length of the heat exchanger.

SUMMARY OF THE INVENTION

It is an object of the present invention to improve the efficiency of the heat exchanger and to thereby allow for a more compact construction of the overall system.

According to the present invention, this object is achieved by the feature that the pressing member has a curved surface over which portions of the belt are guided over a substantial part of the length of the counter flow heat exchanger, and the curved surface co-rotates with the belt portion that is in direct contact therewith.

Thus, the heat exchanger is essentially formed by a curved path on which the two belt portions are superposed on the curved surface of the pressing member. As a result, the outer portion of the belt is pressed against the inner one, which is directly supported by the pressing member, with a force that is proportional to the belt tension and increases with increasing curvature of the pressing member. As a result, the two belt portions moving in opposite directions are held in close contact with each other due to the pressing force which can be finely adjusted by appropriately selecting the belt tension. This assures a good reproducible heat transfer from one belt layer to the other, so that the efficiency of the heat exchanger is increased and the length thereof can be reduced. As will be illustrated hereinafter, the efficiency of the heat exchanger is remarkably increased in comparison with the configuration as shown in U.S. Pat. No. 5,103,263.

In addition, the curved configuration of the counter current heat exchanger makes it possible to arrange the first and second processing stations in relatively close proximity to one another, in spite of the necessary length of the heat exchanger. As a result, a compact construction of the overall system is achieved.

It will be further understood that the second processing station operating at higher temperature should be insulated against thermal losses, so that, ideally, the heat is dissipated only through the heat exchanger.

According to the present invention, the pressing member is a cylindrically shaped member which co-rotates with one of the belt portions forming the heat exchanger. Thus, no friction will occur between the pressing member and the belt portion directly supported thereon. Friction will occur only between the opposed surfaces of the two belt layers superposed on the circumference of the rotating drum. These surfaces, however, which are not the image carrying surfaces of the belt, may have a comparatively low friction coefficient, so that the frictional resistance is minimised.

The drum forming the pressing member should be made of a material which has a small heat conductivity and a small heat capacity, so that the heat of the hot portion of the belt will be dissipated substantially to the cooler belt portion but not to the drum serving as a pressing member.

In order to further minimise the thermal contact between the belt and the drum, it is preferable to provide a pattern of grooves on the surface of the drum, so that the drum will be in contact with the belt only in ridge or island portions defined between the grooves. Of course, the width of the grooves should be small enough to avoid any distortion of the belt layers which could have a negative effect on the image quality or on the durability of the belt and to assure appropriate thermal contact of the entire belt areas in the heat exchanger.

In order to increase the temperature of the belt up to the process temperature needed in the second processing station, a heater will generally be arranged between the heat exchanger and the second processing station. As a result, there exists a temperature difference between the belt portion exiting from the heat exchanger toward the second processing station and the portion re-entering from the second processing station into the heat exchanger. Such a temperature difference is necessary for maintaining the heat transfer from one belt layer to the other within the heat exchanger. If thermal losses are reduced to such an extent that they may be neglected, conservation of energy requires that the same temperature difference is present between the two belt layers over the whole length of the heat exchanger. Consequently, this temperature difference will also be present between the belt portion exiting from the heat exchanger towards the first processing station and the portion re-entering into the heat exchanger from the first processing station. This means that the heat energy which has been supplied by the heater on the side of the second processing station must be extracted on the side of the first processing station.

In order to achieve a compact construction, this heat extraction is preferably promoted by an active cooling system, e.g. an air or a water-cooled drum which preferably deflects the belt by a comparatively large angle, e.g. an angle of about 180°. For example, the cooling drum may be situated upstream of the first processing station and may be arranged to cool the belt to a temperature sufficient low to avoid that the first procession station is warmed up by the belt above the operating temperature of the first processing station. This design has the advantage that the cooling function is completely removed from the first processing station itself, so that the component parts forming the first processing station can be reduced in complexity.

BRIEF DESCRIPTION OF THE DRAWINGS

The above and other features and advantages of the present invention will be described in detail in the following description of a preferred embodiment in conjunction with the accompanying drawings in which.

DETAILED DESCRIPTION OF THE INVENTION

Figure 1:
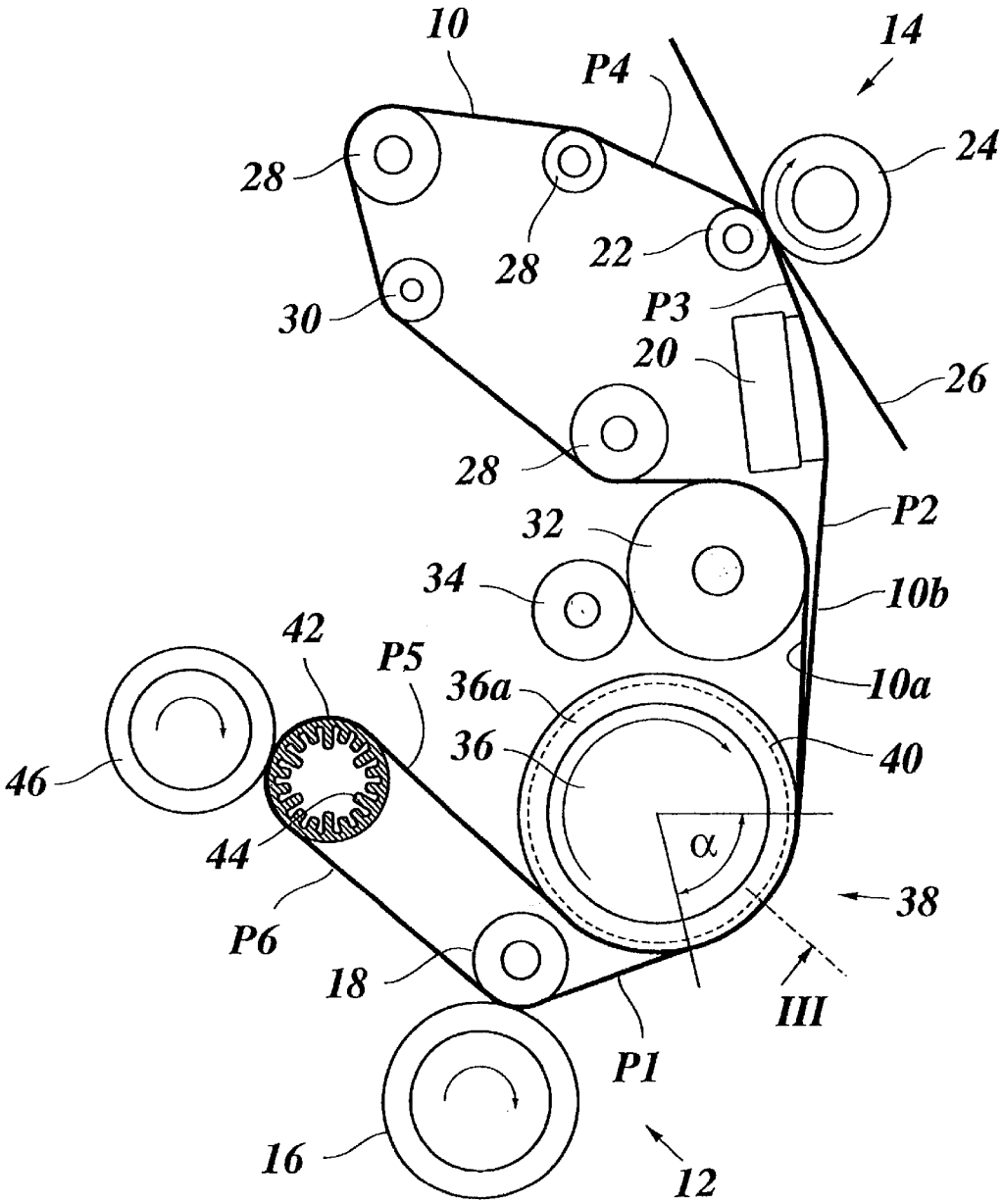
FIG. 1 is a diagram of an image transfer system.

The image transfer system shown in FIG. 1 comprises an endless belt 10 which passes through a first processing station 12 and a second processing station 14.

The first processing station 12 comprises an electrode drum 16 and a pressure roller 18 forming a nip through which the belt 10 passes.

As is generally known in the art, the electrode drum 16 comprises a large number of circumferentially extending electrodes and electronic control circuitry (not shown) accommodated inside of the drum for energizing the electrodes in accordance with image information supplied thereto. When an electrode is energised, toner powder is electrically attracted from a magnetic brush (not shown) positioned at the circumference of the drum. Thus, by energising the various electrodes at appropriate timings, a toner image is formed on the circumferential surface of the electrode drum 16. For a more detailed description of this imaging process, reference is made to U.S. Pat. No. 4,884,188, the description of which is enclosed herein by reference. The toner image is then transferred onto the outer surface of the endless belt 10 when the latter passes through the nip between the drum 16 and the pressure roller 18.

The belt 10 carrying the toner image is guided over a heater 20 which engages the back side of the belt and heats the belt to a temperature at which the toner image becomes tacky.

The second processing station 14 comprises a pair of transfer rollers 22, 24. The belt 10 passes through a nip between the rollers 22, 24, and a sheet of copy paper 26 is supplied to the pair of transfer rollers and passed through the same nip together with the belt 10, so that the tacky toner image is transferred onto the copy paper 26 and is at the same time heat-fused thereon.

The belt 10 is then guided over a number of guide rollers 28 and a tensioning roller 30 for adjusting the belt tension and is then passed over a cleaning roller 32 where it is deflected at an angle of approximately 90°.

A portion 10*a* of the belt 10 which has left the cleaning roller 32 is almost but not completely parallel to a portion 10*b* of the belt which moves towards the heater 20. Both portions 10*a* and 10*b* of the belt are deflected by a deflecting roller 36 which may be either idling or actively driven, so that its circumferential speed is identical with the speed of the belt portion 10*a* which is directly in contact with the deflecting roller 36. Due to the tension of the belt 10, the portion 10*b* is pressed into close sliding contact with the portion 10*a* supported on the deflecting roller 36 over the entire length of an with the angle $\alpha$. The two portions 10*a*, 10*b* of the belt 10 held in close contact with each other on the arc-shaped path defined by the deflecting roller 36 form a counter current heat exchanger 38. When the two portions 10*a* and 10*b* move through the heat exchanger 38 in opposite directions, heat is transferred from the portion 10*a* to the portion 10*b*, so that the temperature of the latter increases whereas the temperature of the former decreases. Thus, a major part of the heat generated by the heater 20 and carried away with the belt 10 is recovered and is used for preheating the belt portion 10*b* before it is heated to the final process temperature by the heater 20.

The compressive force which the belt portion 10*b* exerts on the portion 10*a* depends among others on the tension of the belt 10 and on the curvature of the deflecting roller 36. The smaller the radius of the deflecting roller, the larger is the compressive force which assures a good thermal contact between the two belt portions 10*a* and 10*b*. On the other hand, the radius of the deflecting roller 36 and the angle $\alpha$ determine the effective length of the heat exchanger 38. This length might however be increased by relocating the heater 20 such that the belt portions 10*a* and 10*b* are held in loose contact with each other on the path between the deflecting roller 36 and the cleaning roller 32.

In order to further reduce thermal contact between the relatively hot belt portion 10*a* and the deflecting roller 36, a pattern of circumferentially and or axially extending grooves 40 may be formed in the circumferential surface of the deflecting roller 36. A suitable pattern of grooves is disclosed in GB 1 523 928.

The belt portion 10*a* leaving the deflecting roller 36 is deflected at an angle of approximately 180° by a cooling roller 42 through which a cooling medium, e.g., water or air, flows and which is internally provided with cooling fins 44.

The cooling roller 42 forms a nip with another cleaning roller 46 which is adapted to remove those materials from the belt surface which can most efficiently be removed at a relatively low belt temperature.

When the belt 10 has been cooled down by the cooling roller 42 to a temperature below the maximum operating temperature of the first processing station 12, it is returned to the nip between the drum 16 and the pressing roller 18, where another toner image is applied. When passing through this nip, the temperature of the belt 10 may be slightly raised again by waste heat generated by the electronic components in the electrode drum 16.

Figure 2:
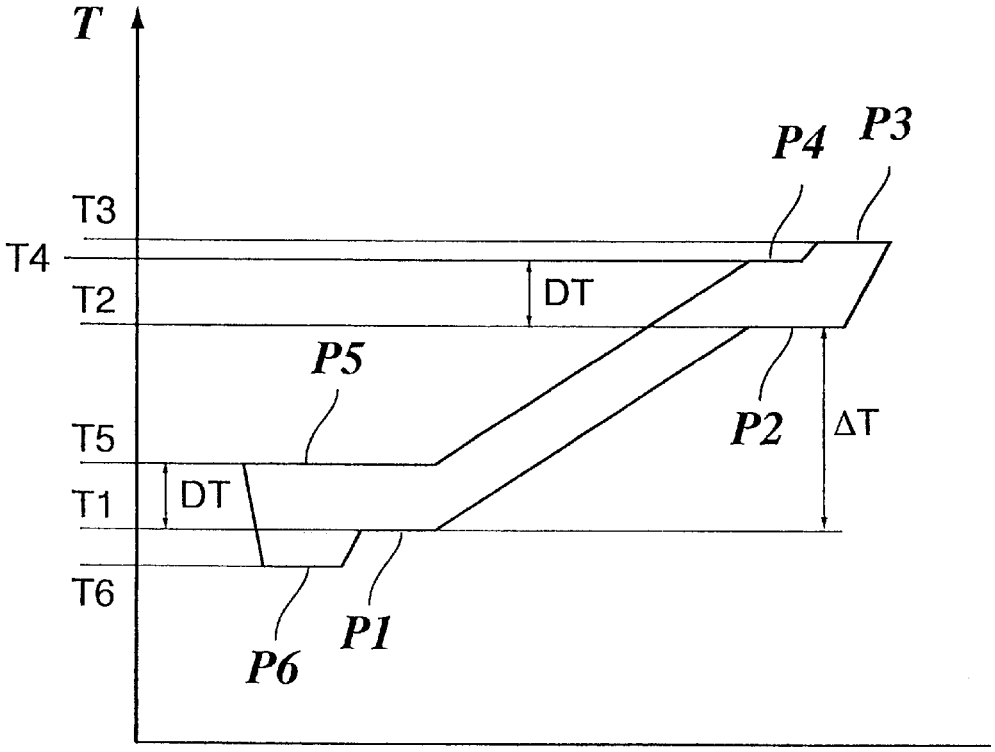
FIG. 2 is a temperature diagram showing the temperature distribution along the belt of the image transfer system.

FIG. 2 illustrates the temperature distribution along the belt 10. The temperature levels T1 . . . T6 indicate the temperature of the belt at the locations P1 . . . P6 indicated in FIG. 1.

At P1, the belt has left the first processing station 12 with the relatively low temperature T1. Then, the heat exchanger 38 raises the temperature of the belt to T2. ΔT=T2−T1 indicates the heating effect of the heat exchanger 38. Between P2 and P3 the belt is heated further by the heater 20, so that it enters into the second processing station 14 with the temperature T3. In the second processing station 14 the temperature drops to T4, because a certain amount of heat is transferred to the copy paper 26.

Between P4 and P5 the belt (the portion 10*a*) passes again through the heat exchanger 38 so that the belt temperature drops to T5. DT indicates the temperature difference between the belt portions 10*a* and 10*b* in the heat exchanger 38. This temperature difference is theoretically constant over the whole length of the heat exchanger.

Between P5 and P6 the belt passes over the cooling roller 42, so that the temperature drops to T6. Then, in the first processing station 12, the temperature is again slightly raised to T1, which means that waste heat is removed from the electrode drum 16.

As can be seen in FIG. 2, the heating effect ΔT of the heat exchanger 38 may be significantly larger than the temperature difference DT between the two belt portions in the heat exchanger. Each of the temperature values ΔT and DT corresponds to a certain amount of heat energy which is transferred to or from the belt 10. But only the heat energy corresponding to DT contributes to the power consumption of the copying machine, whereas the larger heat energy which corresponds to ΔT is recovered in the heat exchanger 38. Thus, the heat exchanger 38 permits to significantly reduce the power consumption of the printer.

In order to minimise the power consumption, DT should be made as small as possible. On the other hand, DT must be large enough to maintain a sufficient transfer of heat from the belt portion 10*a* to the belt portion 10*b* so as to reduce the temperature of the belt portion 10*a* from T4 to T5. DT can be made smaller when the length of the heat exchanger 38 is increased. Likewise, DT can be made smaller when the belt 10 has a small heat capacity and/or a high heat conductivity. Another factor which would tend to increase DT would be a thermal barrier at the surface boundary between the belt portions 10*a* and 10*b* in the heat exchanger. However, thanks to the curved path of the heat exchanger and the resulting pressing engagement between the belt portions 10*a* and 10*b*, such a thermal barrier is practically eliminated, so that DT can be made as small as the heat capacity and heat conductivity of the belt 10 permit. As a result, a desirably large ratio ΔT/DT can be achieved already with a comparatively short heat exchanger.

Moreover, in order to decrease the heat capacity of the belt and to increase heat transfer, the thickness of the belt support should be made as small as the mechanical strength requirements permit. In a practical embodiment, the belt 10 has a total thickness not more than 250 micrometers, and preferably in the order of 100 μm and is composed of a substrate layer with a thickness of approximately 50 μm and a surface coating of approximately 50 μm on the image carrying side. This surface coating is optimised in view of the image transfer properties. A suitable material for the substrate layer is a synthetic resin such as a polyimide, for example. Suitable surface coatings for this support are disclosed for example in EP-A 0 349 072.

The diagram shown in FIG. 2 is idealised in that thermal losses due to incomplete thermal insulation, especially in the hot parts of the system, have been neglected. In practice, such thermal losses may, among others, be caused by heat transfer to the deflecting roller 36. For this reason, the deflecting roller is made of a synthetic resin which has a small heat capacity and also a small heat conductivity. A suitable material is Polyurethane (PUR), for example. In a practical embodiment, the deflecting drum 36 has an overall diameter of 70 mm, including an outer PUR layer 36*a* with a thickness of 14.5 mm. Preferably, a surface coating with a thickness of, e.g., 100 μm is applied to the outer layer. The material of this surface coating preferably consists of an elastomeric material such as silicon rubber.

Figure 3:
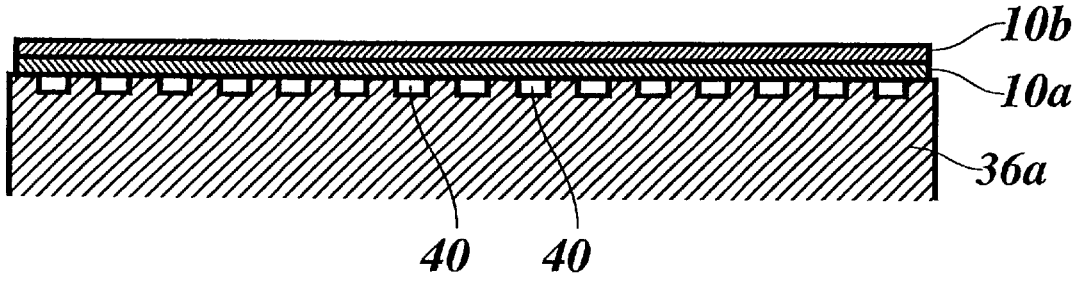
FIG. 3 is a cross-sectional view in the direction of the arrow III in FIG. 1.

FIG. 3 illustrates the pattern of grooves 40 in the PUR layer 36*a* of the deflecting drum. These grooves reduce the area of contact between the deflecting roller 36 and the belt 10 and thereby further reduce the thermal losses. Optionally, a pattern of cross-wise longitudinal and circumferential or diagonal groves may be used.

The temperature diagram shown in FIG. 2 corresponds to a stable condition in which the printer is operating continuously and the belt 10 is warmed-up. When the printer is inoperative for a certain period of time, the heater is switched off in order to reduce power consumption, and, as a result, the temperature of the belt will drop below the operating temperature required in the second processing station 14. When, then, the printer is used again, a certain time is required for warming up the belt to its operating temperature. The heat recovery achieved by the heat exchanger 38 then has the advantageous effect that the warming-up process is accelerated, and this results in a further reduction in the effective power consumption of the machine.

The advantageous results achieved according to the present invention in comparison to the embodiments as disclosed in the aforementioned U.S. Pat. No. 5,103,263, can be illustrated as follows: a printing apparatus was configured according to the embodiment shown in FIG. 1. A belt 10 made of a polyimide was utilized, said belt containing 5% by weight of carbon black to enhance heat conductivity and having a thickness of 50 micrometers. The outer surface of the belt 10, on the side facing electrode drum 16, is provided with a 50 micrometers thick layer of a silicon rubber having the composition as disclosed in example 2 of EP-A 0 349 072. The length of the belt 10 is 681 mm. Deflecting roller 36 has an outer diameter of 70 mm and consists of a aluminum pipe having a 14.5 mm thick outer layer of polyurethane in which about 7 mm deep grooves are cut in both the axial and rotational direction, whereby about 85% of the total surface of the polyurethane layer is removed. The top surface of the remaining height of polyurethane is covered with about a 100 micrometers thick layer of silicon rubber having the same composition as the silicon rubber layer on the outer surface of belt 10.

Rollers 18 and 28 consist of aluminum having a diameter of 14 mm and a 3 mm thick coating of polyurethane.

Roller 22 consists of a massive steel roller with a diameter of 14 mm having a 1 mm thick coating of EPDM (hardness 45° Shore A) and on the top thereof a 100 micrometers thick layer of silicon rubber according to Example 2 of EP-A-0349072.

Roller 24 consists of a steel roller with a diameter of 30 mm and a 1 mm thick coating of EPDM (hardness 60° Shore A).

The length of the heat exchange zone around deflection roller 36 is 51 mm. The belt speed is 12 m/minute (200 mm/sec), which equals the printing speed of 45 pages, size A4, per minute.

To bring the printing machine from a shut off state at room temperature (about 22° C.) to the operational mode, wherein the temperature of belt 10 amounts to about 92° C. upon entering the nip between rollers 22 and 24, the heater 20 needs a power supply of 800 W within 1.8 sec. Thereafter, the power supply is lowered rapidly to about 450 W after 3 more seconds and 370 W after 90 seconds. In a continuous print production run, the power supply to the heater 20 was only 210 W, while the "efficiency" of the heat exchange area is 380 W.

In an embodiment in which deflecting roller 36 is provided with a continuous (non-grooved) layer of polyurethane in an uniform thickness of 14 mm, the continuous print production run is about 300 W.

Using a deflecting roller with a 14.6 mm thick layer of silicon rubber, the efficiency of the heat exchanger in a continuous print production run is about 270 W.

In all the above embodiments the efficiency of the heat exchanger was such that the apparatus needed at most about 15 seconds to attain a ready to print status from a wait or shut off mode in which no energy is supplied to the heater 20. In the most preferred embodiment of the present invention, using a deflecting roller with a grooved surface layer, the ready to print status was attained in less than 5 seconds.

Thus the present invention provides a relatively high speed printing machine, needing virtually no power when in a wait mode.

In a comparable embodiment in which the apparatus has the same configuration as described above with respect to FIG. 1, but in which the deflecting roller 36 is omitted and the heat exchange zone is configured as shown in FIGS. 1 and 2, respectively, of U.S. Pat. No. 5,103,263, and the length of the heat exchange zone is also 51 mm, an efficiency of the heat exchanger of only 100, respectively 150 W could be achieved under most favorable circumstances.

Moreover, it has been found that, contrary to the embodiments as described in U.S. Pat. No. 5,103,263, in the embodiments according to the invention, the efficiency of the heat exchanger is substantially effected by the heat conductivity of the support of belt 10. Thus by further improving the heat conductivity of belt support, a higher efficiency than the presently achieved highest value of 380 W can be attained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image transfer system comprising an endless belt serving as an image carrier and passing through a first processing station where it is maintained at a low temperature and through a second processing station where it is maintained at a higher temperature, and a counter current heat exchanger formed by two portions of said endless belt moving in opposite directions and held in sliding contact with each other by a pressing member, wherein said pressing member is a deflecting roller which co-rotates with the belt portion that is directly in contact therewith.

2. The image transfer system as claimed in claim 1, wherein at least a surface layer of the pressing member is made of a synthetic resin having a small heat capacity and a small heat conductivity.

3. The image transfer system as claimed in claim 1, wherein the pressing member has a pattern of grooves formed in the surface which contacts the endless belt.

4. The image transfer system as claimed in claim 3, wherein the belt has a thickness of 250 $\mu$m or less.

5. The image transfer system as claimed in claim 1, wherein an active cooling system is provided for cooling the endless belt in the vicinity of the first processing station.

6. The image transfer system as claimed in claim 5, wherein the active cooling system is formed by a cooling roller through which a cooling medium is passed and which deflects the endless belt at an angle of approximately 180°.

7. The image transfer system as claimed in claim 6, wherein the active cooling system is provided upstream of the first processing station and downstream of the pressing member.

8. The image transfer system as claimed in claim 1, wherein a cleaning roller is provided for cleaning the belt between the heat exchanger and the first processing station.

9. The image transfer system as claimed in claim 8, wherein the cleaning roller engages the endless belt on the surface of the cooling roller.

10. A method for transferring a toner image developed and transferred to an endless belt in a first processing station and transferred from the endless belt to a sheet in a second processing station which comprises heating the endless belt containing the toner image to an elevated temperature prior to being introduced to the second processing station, bringing the endless belt leaving the second processing station into direct countercurrent, surface-to-surface contact with itself prior to said heating, forming two opposing belt portions, and pressing said two opposing belt portions together by a roller in which said belt portions are guided, said roller co-rotating with the belt portions in direct contact therewith.

* * * * *